United States Patent [19]

Glover

[11] 4,304,275

[45] Dec. 8, 1981

[54] LOG DEBARKER

[75] Inventor: Tony L. Glover, Tigerton, Wis.

[73] Assignee: Michael Glover, Tigerton, Wis.

[21] Appl. No.: 104,027

[22] Filed: Dec. 14, 1979

[51] Int. Cl.[3] ..... B27L 1/06

[52] U.S. Cl. ..... 144/208 C; 30/371; 144/208 J

[58] Field of Search ..... 144/208 R, 208 J, 208 C, 144/311; 30/371

[56] References Cited

U.S. PATENT DOCUMENTS

| | | | |
|---|---|---|---|
| 2,637,357 | 5/1953 | Johnson et al. | 144/208 C |
| 2,822,837 | 2/1958 | Clausen | 144/208 J |
| 3,093,170 | 6/1963 | Thayer | 144/208 J |

FOREIGN PATENT DOCUMENTS

| | | | |
|---|---|---|---|
| 1360546 | 3/1964 | France | 144/208 C |
| 199400 | 9/1958 | Sweden | 144/208 C |

*Primary Examiner*—W. D. Bray

*Attorney, Agent, or Firm*—Harvey B. Jacobson

[57] ABSTRACT

A hand held apparatus comprising an engine drivingly connected through a chain and sprocket to a rotatable drum. The drum has a spiral groove formed therein which mounts a chain saw-type chain. The drum is mounted on a frame together with a cradle which supports the drum in surface contact relation to a log to be debarked. The cradle pivots on the frame and contains a pair of concave rollers which contact the log.

9 Claims, 4 Drawing Figures

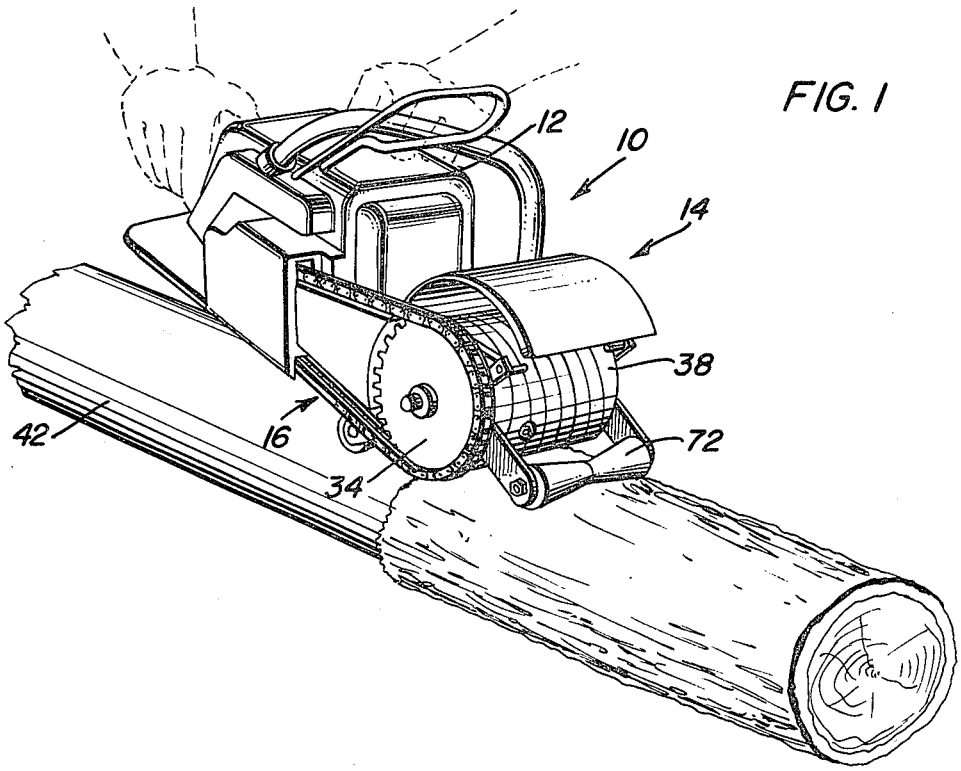
FIG. 1
FIG. 2
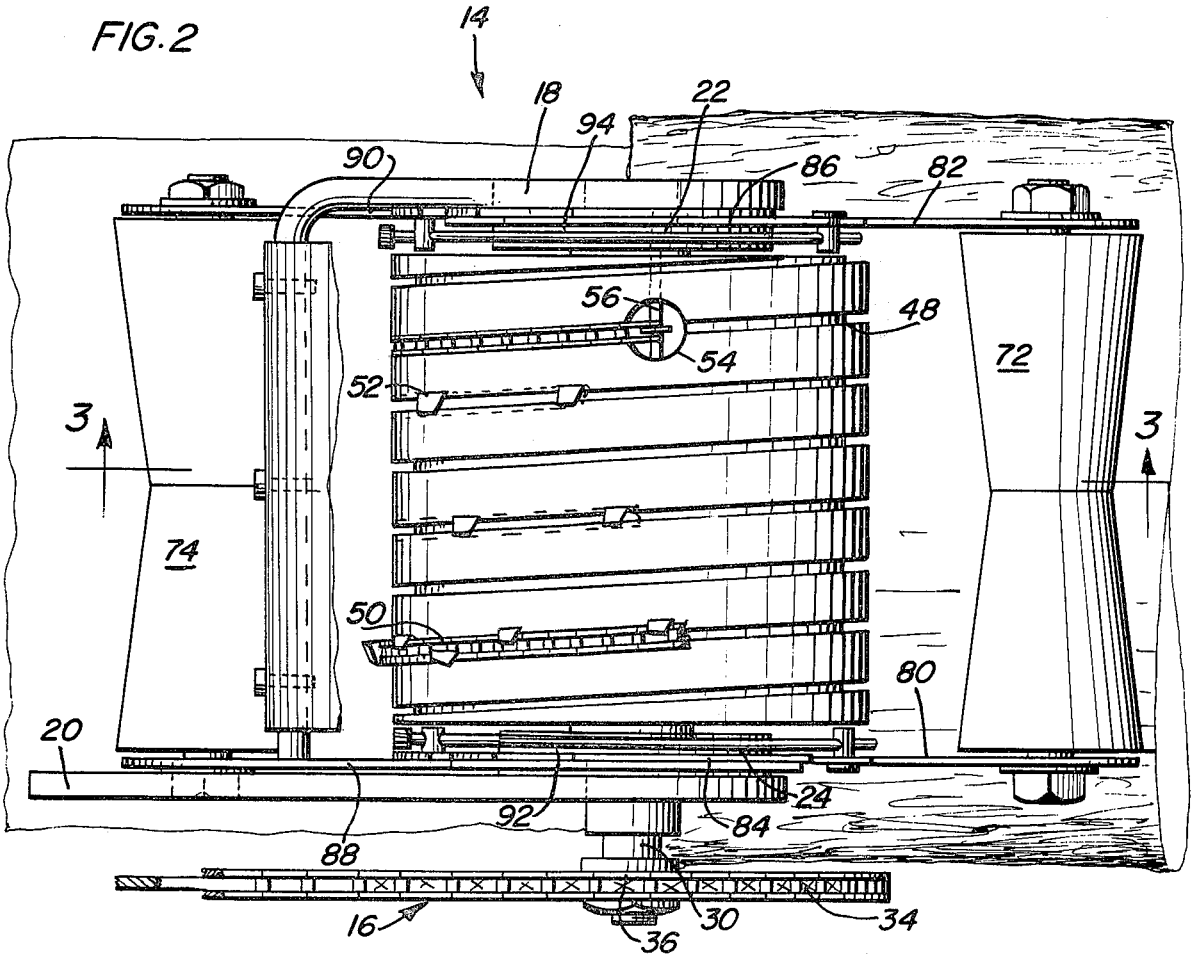

LOG DEBARKER

BACKGROUND OF THE INVENTION

1. Field of the Invention

This invention relates to devices for removing the bark from logs.

2. Discussion of Related Art

In preparation of logs for use as posts, poles, logs for log cabins or pulp, is necessary to remove the bark from the outer surface of the log. Various devices have been suggested for performing this task. For instance, U.S. Pat. No. 2,681,670, issued June 22, 1954 to Prentice, shows a log barking apparatus comprising a rotary cutter head covered by a hood and secured to a shaft which extends longitudinally of the log to be barked. A pair of shoes are mounted at each end of the rotary cutter head and can be moved relatively thereto for minutely adjusting the depth of cut of the cutter head. The cutter head is rotated by a power device while the log is both rotated and moved longitudinally to insure removal of all bark therefrom. U.S. Pat. No. 3,154,121, issued Oct. 27, 1964 to Wallman et al. shows a bark removing attachment preferably for portable chain saws. The attachment comprises a rotary cutter having axially extending blades, the radius of cut of which increase in the direction toward the ends of the cutter.

SUMMARY OF THE INVENTION

One object of the present invention is to provide a log debarking device which is capable of movement longitudinally of a log to remove bark therefrom.

A further object of the present invention is to provide a log debarking device which can be used for cutting flat portions on logs used to build log cabins and the like.

An even still further object of the present invention is to provide a log debarking device which uses a cutting surface having teeth which can be easily removed for repair or replacement in a minimum of time and with a small amount of effort.

One further additional object of the present invention is to provide a log debarking device which uses a cutting surface which is self-cleaning of bark and debris.

Another object of the present invention is to provide a log debarking device having a depth of cut adjustment to compensate for bark having various thicknesses.

In accordance with the above objects, the log debarker of the present invention includes a power drive unit which can be the engine of a chain saw or the like. A frame is connected to the power drive unit and mounts an axle driven from the power drive unit through a chain and sprocket arrangement. The axle is journalled in the frame and mounts a drum having a spiral groove formed therein. A chain saw-type chain is mounted in the spiral groove by a spring mounting arrangement to maintain proper chain tightness. As the drum is rotated, the teeth of the chain contact the bark to be removed and neatly slice the bark from the log. The spiral configuration of the chain causes the device to be self-cleaning. A cradle comprising a pair of guide rollers is pivotally mounted on the frame to provide a gauge for the cutting teeth against the log surface. The guide rollers are machined with a concave surface so as to fit the radius of curvature of the log to inhibit side slip of the debarker and provide substantial control in the debarking operation. One guide roller is positioned in front of and one in back of the drum and the guide rollers are adjustable relative to each other to adjust the drum gauge. In this manner, the operator can compensate easily for logs having various thicknesses of bark.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the log debarker in operation.

FIG. 2 is a fragmental top plan view of the log debarker.

DESCRIPTION OF THE PREFERRED EMBODIMENTS

Figure 3:
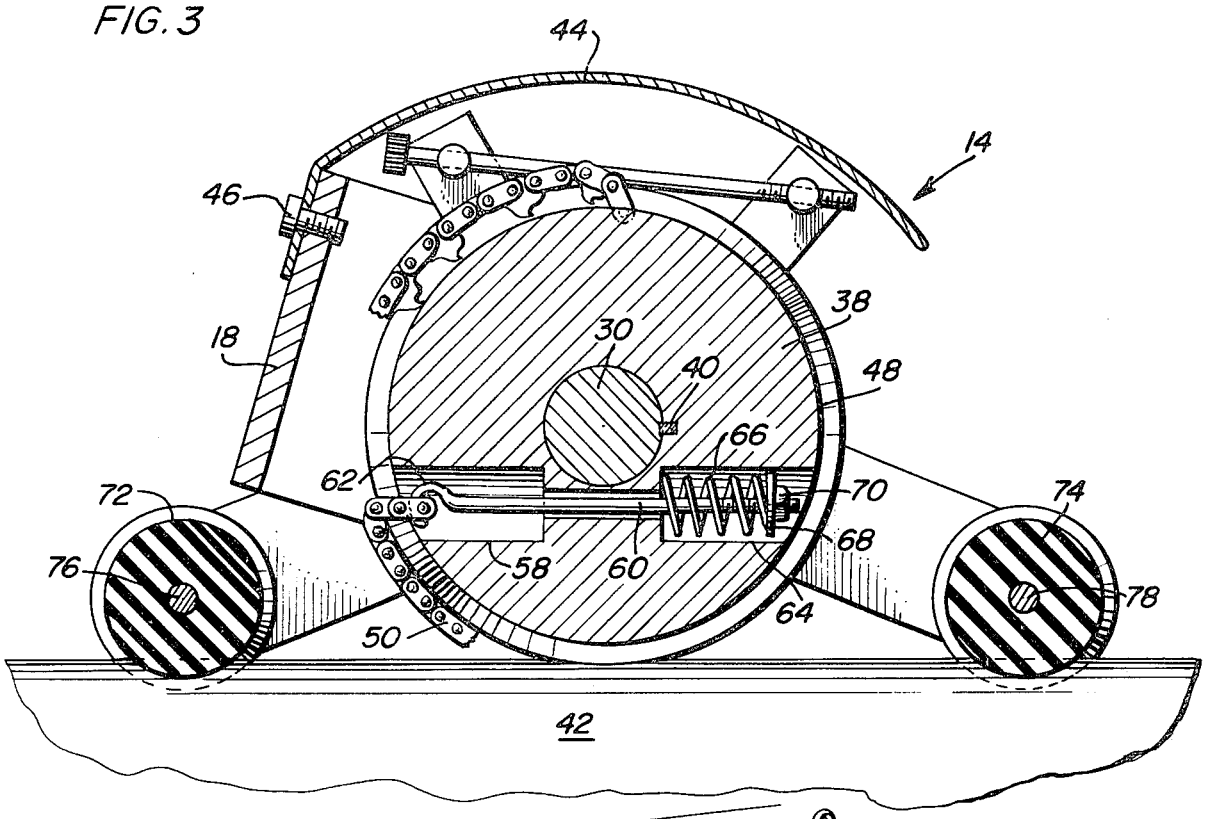
FIG. 3 is a side elevational sectional view taken substantially along the plane passing through section line 3—3 of FIG. 2.
Figure 4:
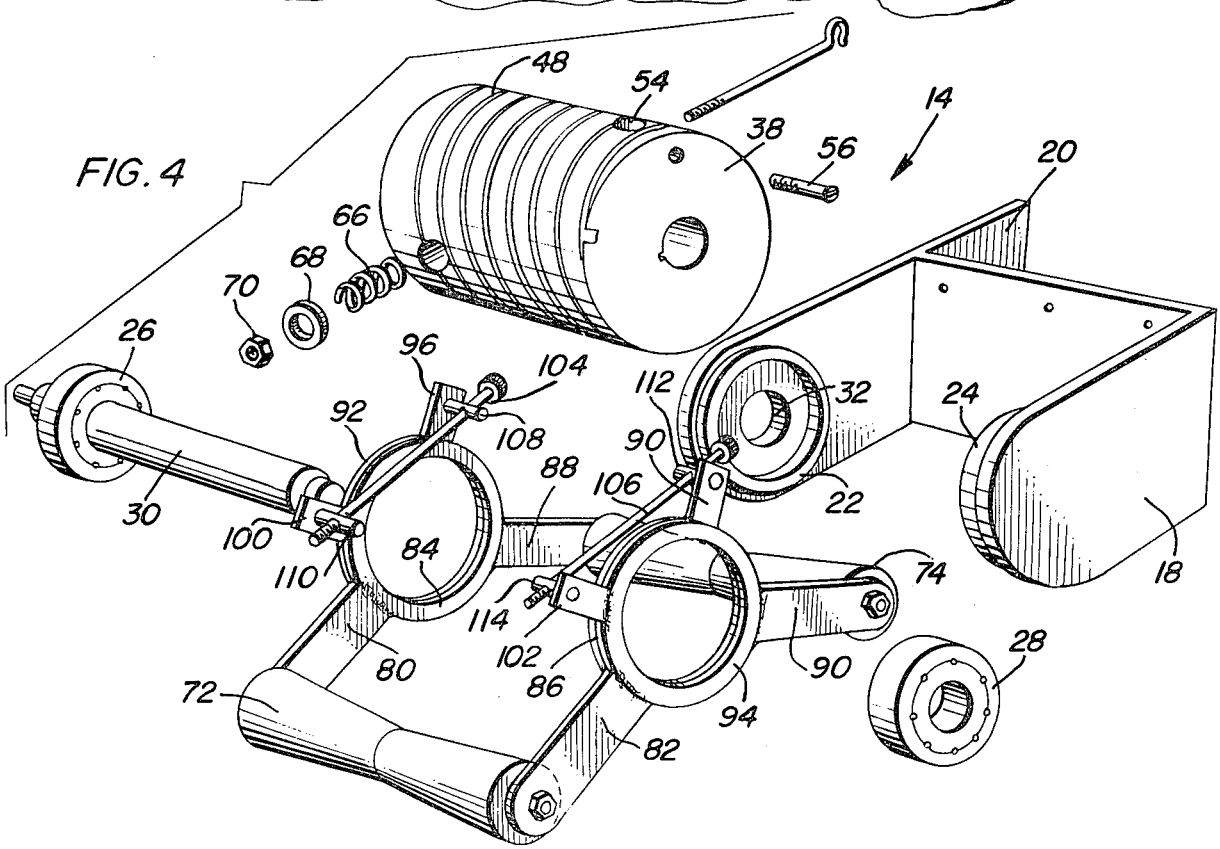
FIG. 4 is an exploded view of the log debarker.

Now with reference to the drawings, a log debarker incorporating the principles and concepts of the present invention and generally referred to by the reference number 10 will be described in detail. Debarker 10 consists of a hand held power unit 12 which can be an internal combustion engine, an electric motor, or the like. Power unit 12 is attached to debarking unit 14 through chain and sprocket drive section 16.

The power unit 12 is similar to that used on a standardly available chain saw and, in fact, the device can be constructed by connecting a debarking unit 14 to an already existing power unit 12 by removing the cutting chain of a chain saw and attaching the elements of the debarking unit together with the chain and sprocket drive 16 as will be described.

The debarking unit 14 comprises a main frame 18 which is generally U-shaped and has a rearward extension 20 which connects to the body of power unit 12 by any suitable attaching mechanism. A pair of flanges 22 and 24 are attached to the legs of frame 18 and serve to mount a pair of bearings 26 and 28, respectively. Bearings 26 and 28 rotatably support and journal axle 30 which extends out of an aperture 32 formed in frame 18 inside of the flange 22. Drive sprocket 34 of chain and sprocket drive 16 is mounted on a reduced end of the axle 30 and held in place by a nut 36. Axle 30 mounts drum 38 which is keyed to the axle via key 40 for rotation therewith. Drum 38 contains the cutting surface which removes the bark from log 42. Obviously, when the power unit 12 is started and the drive 16 engaged, drum 38 will rotate with the drum surface engaging the bark of log 42 and removing the bark therefrom. Drum 38 rotates in a clockwise direction and as seen in FIG. 3 and thus causes the debarker 10 to be pulled forwardly away from the operator along the log. A guard 44 is mounted on the bight of frame 18 through the use of screw devices 46 to reduce the amount of bark chips and debris thrown from the drum toward the operator. Guard 44 is generally arcuate in shape and circumferentially surrounds the upper portions of drum 38.

The drum 38, as shown, has a cylindrical outer surface with a spiral groove 48 formed therein. If desired, the outer surface of the drum 38 can be concave so as to conform to the radius of curvature of the log to be debarked. However, with a cylindrical surface as shown in the drawings, it is possible to produce flat sections along a log in a manner consistent with the production of log cabins, and the like. The actual cutting surface of the drum 38 comprises a chain 50 which is, in fact, a chain saw chain having a plurality of cutting teeth 52 which actually engage the bark of log 42 and remove the bark from the log. The chain 50 is mounted in the spiral groove 48 with the teeth 52 radiating outwardly of the drum. Chain 50 is preferably formed in one continuous length with one end of the chain disposed in an aperture 54 of drum 38 and held in place by threaded pin 56 which extends transversely through the chain and screws into threads formed within the drum 38. The chain is then wrapped about the drum in groove 48 with the opposite end of the chain being disposed in a second aperture 58. An elongated securing rod 60 has a hooked end 62 which engages the end of chain 50. The rod 60 extends through the body 38 into an aperture 64 which contains compression spring 66. Spring 66 rests on one side against a shoulder formed in the aperture 64 and is biased against washer 68 which engages the rod 60 through nut 70. Accordingly, the chain 50 is held in a spring tensioned taut configuration within the groove 48 through the use of compression spring 66. The tension on the chain can be adjusted by merely moving nut 70 in or out on the rod 60. It should be noted that since teeth 52 are spaced longitudinally along the chain 50, it is preferable to dimension the drum 38 such that the teeth 52 are staggered along the surface of the drum as shown generally in FIG. 2. In this manner, the teeth engage the bark sequentially to produce a smooth cutting action. If the teeth were lined up laterally along the surface of the drum, the pull caused by rotation of the drum and teeth engaging with bark could possibly cause a jerky uneven motion which would be disconcerting to the user of the device.

Obviously, by the use of standard chain saw chains as the cutting surface of the drum 38 as described, the user can easily remove the chain for sharpening or replacement quickly and easily. Replacement chains are readily available as these are standard items of manufacture. Furthermore, the spiral configuration of the chain position on the surface of the drum 38 causes the chain and drum to be self-cleaning of bark and other debris. As the drum rotates, the bark chips which are cut free and remain under the drum are moved sideways under the action of the chain 50 and discharged from the device.

In order to maintain proper gauge between the drum 38 and log 42 being debarked, a pair of guide rollers 72 and 74 are mounted on the frame 18 in supporting relation to the drum 38. Guide rollers 72 and 74 are mounted directly on spindles 76 and 78, respectively. Each spindle is bolted to its own mounting structure. The mounting structure for spindle 72 includes spindle carrying arms 80 and 82 which are attached at their inner ends to rings 84 and 86, respectively. Rings 84 and 86 fit over the outside of annular flanges 22 and 24, respectively, and allow the mounting structure to pivot thereon thus changing the orientation of guide rollers 72. In like manner, guide rollers 74 are supported by a mounting structure comprising spindle support arms 88 and 90 which are respectively connected to rings 92 and 94. Rings 92 and 94 also are mounted about the exterior of flanges 22 and 24 and thus can allow changes in angular orientation of the mounting structure for the guide roller 74. Obviously, since rings 84, 92 and 86, 94 are capable of rotation relative to each other, the orientation of the rollers 72, 74 can be changed with the rollers either being moved closer to one another or further from one another. A change in this relative location of the rollers also causes a change in the distance of drum 38 from a workpiece such as log 42 being debarked. This then allows the user to compensate for various thicknesses of bark. In order to maintain the desired gauge for the drum 38, each ring 84, 86, 92 and 94 is provided with a mounting flange 96, 98, 100 and 102, respectively. The mounting flanges are arranged in pairs on associated rings and connected by threaded adjustment screws 104 and 106. Adjustment screw 104 passes through a pair of mounting bosses 108 and 110 which are pivotally attached to flanges 96 and 100, respectively. In like manner, adjustment screw 106 passes through a pair of mounting bosses 112 and 114 which are rotatably attached to flanges 98 and 102, respectively. When the screws 104 and 106 are rotated, the associated flanges are caused to converge thus moving the rollers 72 and 74 downward and convergingly inward to raise the drum 38 from the work surface. Conversely, the screws 104 and 106 can be rotated to cause divergence of their associated flanges and, accordingly, divergence of the rollers 72 and 74 to lower the drum 38 to the work surface.

The debarker 10 can be used manually as shown in FIG. 1 with the rollers 72 and 74 used to guide the debarker longitudinally along the log with the rotation of drum 38 aiding in this movement and causing a continuous force on the debarker away from the operator. The debarker 10 can also be mounted on a track for automatic operation and logs can be sized in diameter for the debarking process.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A debarking device for removing bark from logs, said debarking device comprising: a power drive means; a drum rotatably mounted and operatively connected to said power drive means; a cutting means mounted on said drum for contacting and removing bark from a log, said cutting means including a plurality of teeth aligned in a spiral configuration about the surface of said drum; gauge means for maintaining a predetermined gauge between said cutting means and a log being debarked, said gauge means comprising a pair of guide rollers mounted in lateral spaced relation to said drum, a mounting bracket connected to each of said guide rollers, each of said mounting brackets being mounted for pivotal movement about said drum, said gauge means including an adjustment means connected between said mounting brackets for holding said mounting brackets in a fixed angular orientation.

2. The debarking device defined in claim 1 and further including a spiral groove formed in the surface of said drum, said cutting teeth being mounted along said groove.

3. The debarking device defined in claim 2 wherein said cutting means further includes chain links connected between said aligned teeth to form a chain holding said teeth together.

4. The debarking device defined in claim 3 and further including a spring connected between one end of said chain and said drum for holding said chain in tight engagement against said drum.

5. The debarking device defined in claim 1 wherein each of said guide rollers has a concave surface.

6. The debarking device of claim 3 wherein said chain links and said teeth form a chain saw cutting chain.

7. In a debarking apparatus, the combination of: a mounting bracket having two parallel legs; a drum rotatably mounted between said bracket legs, a plurality of cutting teeth mounted to the surface of said drum; a pair of guide rollers; mounting arms connected to said guide rollers and pivotally attached to the legs of said frame for mounting said guide rollers on each side of said drum; a guard means connected to said frame and extending over said drum, said cutting teeth being attached at spaced intervals along a chain, said chain being attached in a spiral configuration along the surface of said drum, said drum including a spiral groove formed in the surface of said drum, said chain being held against said groove for stability, a securing rod having one end connected to said one end of said chain, said securing rod passing through an aperture formed in said drum; a spring connected between the opposite end of said securing rod and said drum for holding said chain in tight engagement to said drum.

8. In a debarking apparatus including a driven rotary drum, said drum including a spiral groove formed in the outer surface thereof, an elongated chain including longitudinally spaced cutting teeth, said chain being spiraled about said drum and held against said groove for stability, means anchoring one end of said chain to said drum, a securing rod having one end connected to the other end of said chain, said drum having an aperture formed therein, said rod being passed through said aperture, and a spring connected between the other end of said rod and said drum for holding said chain in tight engagement with said drum.

9. In a debarking apparatus including a driven rotary drum having cutting teeth spaced axially therealong, a frame from which said drum is journaled for rotation about its longitudinal center axis, a pair of first and second arms oscillatably mounted at one pair of corresponding ends thereof from said frame at each end of said drum and for swinging movement of said arms relative to each other and to said frame about axes substantially corresponding with said center axis, said arms extending generally radially of said axis and projecting radially outwardly beyond the outer periphery of said drum, said first arms extending generally in the same first radial direction, said second arms extending in generally the same second radial direction and being angularly displaced relative to said first arms, first and second guide rollers journaled between the other pair of corresponding ends of said first and second arms, respectively, and adjustment means operatively connected between said first and second arms for selectively varying the relative angular displacement thereof.

* * * * *